US006357065B1

(12) United States Patent
Adams

(10) Patent No.: US 6,357,065 B1
(45) Date of Patent: Mar. 19, 2002

(54) VARIABLE WIDTH BARIATRIC MODULARBED

(75) Inventor: Craig D. Adams, Medford, OR (US)

(73) Assignee: Mellen Air Manufacturing, Inc., Long Beach, CA (US)

( * ) Notice: Subject to any disclaimer, the term of this patent is extended or adjusted under 35 U.S.C. 154(b) by 0 days.

(21) Appl. No.: 09/440,108

(22) Filed: Nov. 15, 1999

(51) Int. Cl.[7] ..... A61G 7/015

(52) U.S. Cl. ..... 5/618; 5/617; 5/611

(58) Field of Search ..... 5/611, 616, 617, 5/618, 156, 184, 222, 251, 620, 627

(56) References Cited

U.S. PATENT DOCUMENTS 4,409,695 A * 10/1983 Johnston et al. ..... 5/68
5,083,332 A * 1/1992 Foster et al. ..... 5/185
5,628,078 A * 5/1997 Pennington et al. ..... 5/618
5,729,849 A * 3/1998 Garakani ..... 5/618

* cited by examiner

*Primary Examiner*—Lynne H. Browne
*Assistant Examiner*—Fredrick Conley
(74) *Attorney, Agent, or Firm*—Morland C. Fischer

(57) ABSTRACT

A variable width bariatric bed including a frame having a modular configuration with front end, rear end and middle frame sections that are detachable from one another to facilitate storage, transport and relocation through narrow entrances. A series of electric motors carried by the frame apply pushing forces to raise a plurality of mattress support deck sections to adjust the contour of a mattress. Each of the mattress support deck sections has a pair of pull out extensions that are adapted to slide outwardly and in opposite directions from a retracted position to an extended position at which the mattress support deck sections have a relatively wide width to support a correspondingly wide (e.g. 48 inch) mattress. Such mattress includes a mattress body and a pair of (e.g. foam or air filled) mattress extensions that are releasably connected at opposite sides of the mattress body and seated upon the pair of pull out extensions of the mattress support deck sections.

20 Claims, 9 Drawing Sheets

VARIABLE WIDTH BARIATRIC MODULARBED

BACKGROUND OF THE INVENTION

1. Field of the Invention

This invention relates to a variable width bariatric modular bed having a frame that can be separated into modularized frame sections to facilitate transport and storage and a plurality of mattress support deck sections connected to the frame to vary the mattress contour and having pull out extensions upon which to support a relatively wide (e.g. 48 inch) mattress that is particularly suitable for use by obese patients.

2. Background Art

A hospital bed is typically adjustable to control both mattress contour and height above the floor. However, a hospital bed is typically an integral unit (i.e. non-modular) and rated for 350 lbs. (160 kg) of weight. The considerable size and weight of a hospital bed is satisfactory for most hospital applications and helps contribute to the durability and stability of the bed. A typical hospital bed is moved infrequently and then solely within the confines of a hospital. The typical use of the bed requires that a patient, on a wheelchair or gurney, if necessary, be brought to the bed. When it is necessary for a hospital bed to be moved, it is usually transported by rolling on strong casters over non-resilient hard floors and by freight elevator between the floors of a multi-story building. A standard hospital bed is typically no wider than 39-inches so as to fit through standard hospital doors.

A bariatric bed has some or all of the capabilities of the aforementioned hospital bed. That is, a bariatric bed is capable of adjusting the contours of a mattress and raising or lowering the elevation of the mattress above the floor. However, a bariatric bed is capable of lifting up to three times the weight of the typical hospital bed. The bariatric bed is also wider than a standard hospital bed and is known to be as wide as 60 inches so as to better support large (i.e. obese) patients. Unlike a standard hospital bed, because of its relatively large width, a bariatric bed will not fit through standard hospital doors and is not easily transported throughout a hospital.

Moreover, those bariatric beds which are currently being used in hospitals have a fixed mattress width. However, in many circumstances, it would be desirable for a bariatric patient to have use of an adjustable mattress width. For example, a relatively wide bariatric mattress would aid healing, improve patient comfort and aid healthcare workers in serving the patient's needs.

Both the typical hospital and bariatric beds usually have one or more electric motors to lift and adjust the contour of the mattress. These electric motors are known to apply a pulling force on structural members attached to the bed frame to elevate the mattress support sections upon which the mattress is laid. However, in the event that an electric motor should break, the corresponding mattress support section has been known to rapidly fall down to its at rest position against the frame. In some cases, the rapid drop of a mattress support section will generate impact forces which are often transferred to a patient lying on the mattress. Such impact force can cause or increase injury to the patient and, therefore, pose a safety concern.

SUMMARY OF THE INVENTION

A variable width bariatric modular bed is disclosed including a frame having front end, rear end and middle frame sections. The middle frame section includes a pair of hollow frame clamps to which the front end and rear end frame sections are detachably connected so that the frame is provided with a modular configuration. The frame sections are detached from one another to facilitate transport, storage or relocation through narrow entrances.

A pair of electric motors are carried by the middle frame section and are pivotally coupled to lift dogs attached to the front end and rear end frame sections. The electric motors apply pushing forces against the lift dogs to cause either the front end frame section or the rear end frame section or the entire frame to be lifted relative to the floor. A third electric motor carried by the middle frame section is coupled to a lift dog attached to a head mattress support deck section, and a forth electric motor also carried by the middle frame section is coupled to another lift dog attached to a thigh mattress support deck section. The third and fourth electric motors apply pushing forces against the lift dogs to cause the head and thigh mattress support deck sections to rotate upwardly relative to the frame to establish a variable and comfortable mattress contour for a patient. A foot mattress support deck section is pivotally coupled to the thigh mattress support deck section so as to be pulled off the frame and held in spaced, parallel alignment therewith. A stationary seat mattress support deck section remains affixed to the frame. The pushing (as opposed to pulling) forces applied by the electric motors to raise the frame and the mattress support deck sections avoid possible injury to a patient in the event that one of the motors should break.

Each of the head, seat, thigh and foot mattress support deck sections has a pair of pull out extensions that are adapted to slide outwardly and in opposite directions from a retracted position, at which the mattress support deck sections have a relatively narrow width to support a conventional (e.g. 36 inch) wide mattress, to an extended position at which the mattress support deck sections have a relatively wide width to support a correspondingly wide (e.g. 48 inch) mattress. Such a wide mattress includes a mattress body and a pair of mattress extensions that are releasably connected at opposite sides of the mattress body. The pair of mattress extensions may be foam or air filled and are seated upon the pair of pull out extensions of the mattress support deck sections. The mattress extensions are releasably connected to the mattress body by means of a zipper so as to be easily separated therefrom to facilitate transport or storage.

DETAILED DESCRIPTION

Figure 1:
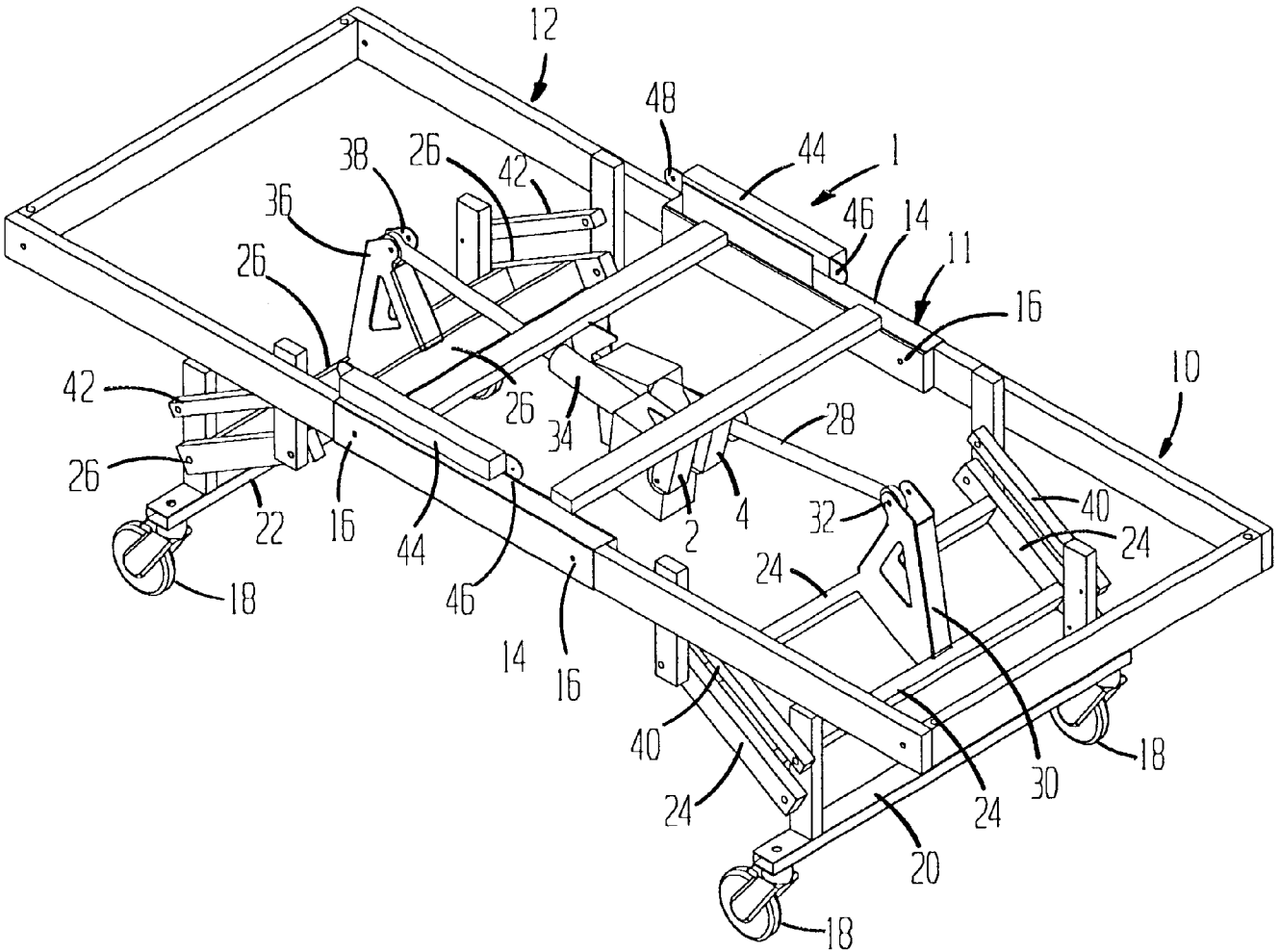
FIG. 1 shows the frame of the variable width bariatric modular bed which forms the present invention in the assembled configuration.
Figure 2:
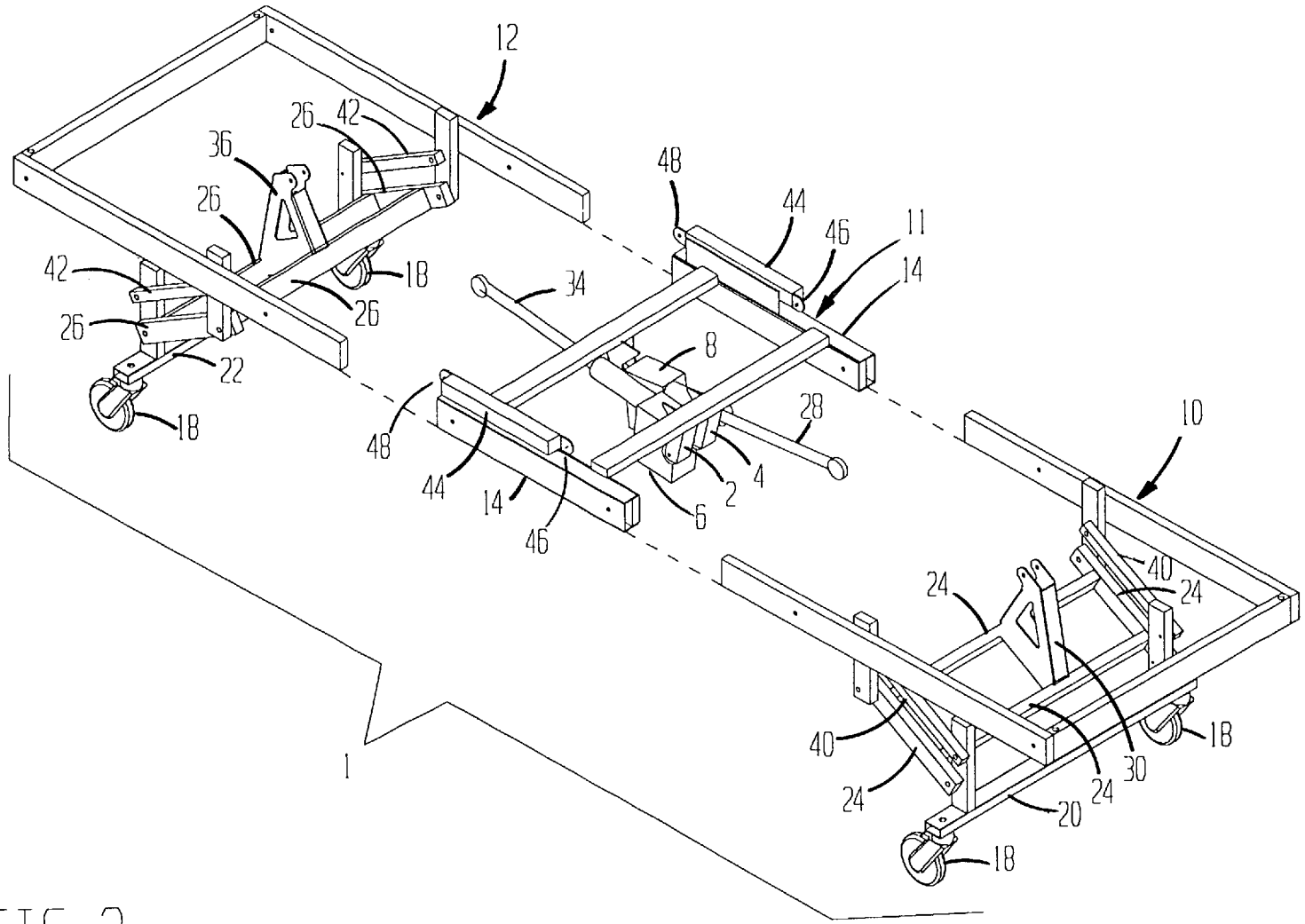
FIG. 2 shows the bed frame of FIG. 1 in a detached, modular configuration.

The frame 1 which forms the variable width bariatric modular bed of this invention is initially described while referring to FIGS. 1 and 2 of the drawings. FIG. 1 shows the bed frame 1 in the assembled configuration common to conventional hospital beds. Although the bed frame 1 carries a total of four electric motors, the motor mounts 2 and 4 for a pair of bed lift motors (designated 6 and 8 and best shown in FIG. 2) are carried by the motor (i.e. middle) section 11 of frame 1. As is also best shown in FIG. 2, the bed frame 1 may be conveniently and advantageously separated into a pair of end frame sections 10 and 12 and the motor (i.e. middle) section 11.

The motor section 11 of frame 1 includes a pair of hollow frame clamps 14 at opposite sides thereof within which to slidably receive opposing ends of the front and rear end frame sections 10 and 12. Each of the pair of frame clamps 14 has a pair of bolts 16 removably received therethrough so that the front and rear end frame sections 10 and 12 may be detachably connected to the motor section 11.

By virtue of the detachable assembly of the front bed frame section 10, the motor section 11, and the rear end frame section 12, the bed frame 1 of this invention can be advantageously modularized. That is to say, and as previously described, by first removing the bolts 16 from the hollow frame clamps 14, the front and rear end frame sections 10 and 12 can be separated from the motor (i.e. middle) section 11 to permit the bed frame 1 to be shipped in separate containers or to be moved section-by-section through tight doorways (e.g. such as that often found in a bedroom). In this same regard, the bed frame 1 of this invention may be quickly and easily assembled by simply sliding the front and rear end frame sections 10 and 12 into receipt by the hollow frame clamps 14 at the opposite sides of the motor section 11. The bolts 16 are then replaced so that the bed frame 1 is now ready for use within a home, hospital or similar healthcare facility.

The bed frame 1 includes a set of four casters 18 that are carried by front and rear caster beam assemblies 20 and 22. The front caster beam assembly 20 is pivotally connected to the front end frame section 10 by means of a first lift assembly 24. The rear caster beam assembly 22 is pivotally connected to the rear end frame section 12 by means of a second lift assembly 26. A motor shaft 28 extends from the first bed lift motor 8 for attachment at a lift dog 30 that is affixed to the first lift assembly 24 at the front end frame section 10. The motor shaft 28 is pivotally connected to lift dog 30 by a removable clevis pin 32. Another motor shaft 34 is connected from the second bed lift motor 6 to a lift dog 36 that is affixed to the second lift assembly 26 at the rear end frame section 12. Motor shaft 34 is pivotally connected to the lift dog 36 by a removable clevis pin 38.

As an important feature of the present invention, each of the shafts 28 and 34 of bed lift motors 6 and 8 apply pushing forces against their respective lift dogs 30 and 36 to cause the bed frame 1 to be lifted as needed to correspondingly elevate a mattress. This is in contrast to conventional bed frames in which lift motors exert a pulling force against the frame to cause the frame to be lifted and a mattress to be elevated. The advantage of the pushing force generated by bed lift motors 6 and 8 to lift a mattress will soon be described.

A first pair of rotating idler arms 40 are connected between the front caster beam assembly 20 and the front end frame section 10. Another pair of rotating idler arms 42 are connected between the rear caster beam assembly 22 and the rear end frame section 12. The pairs of idler arms 40 and 42 rotate in response to the pushing force generated by the bed lift motors 6 and 8 against lift dogs 30 and 36 so as to cause the front and rear caster beam assemblies 20 and 22 to move closer together as the frame 1 is lifted.

The motor section 11 of bed frame 1 includes a pair of deck supports 44 located at opposite sides thereof. Each deck support 44 includes a first coupler 46 to which a head mattress support deck section (designated 50 and best shown in FIGS. 3 and 4) is pivotally connected. Each deck support 44 also includes an opposing coupler 48 to which a thigh mattress support deck section (designated 54 and also best shown in FIGS. 3 and 4) is pivotally connected.

Figure 3:
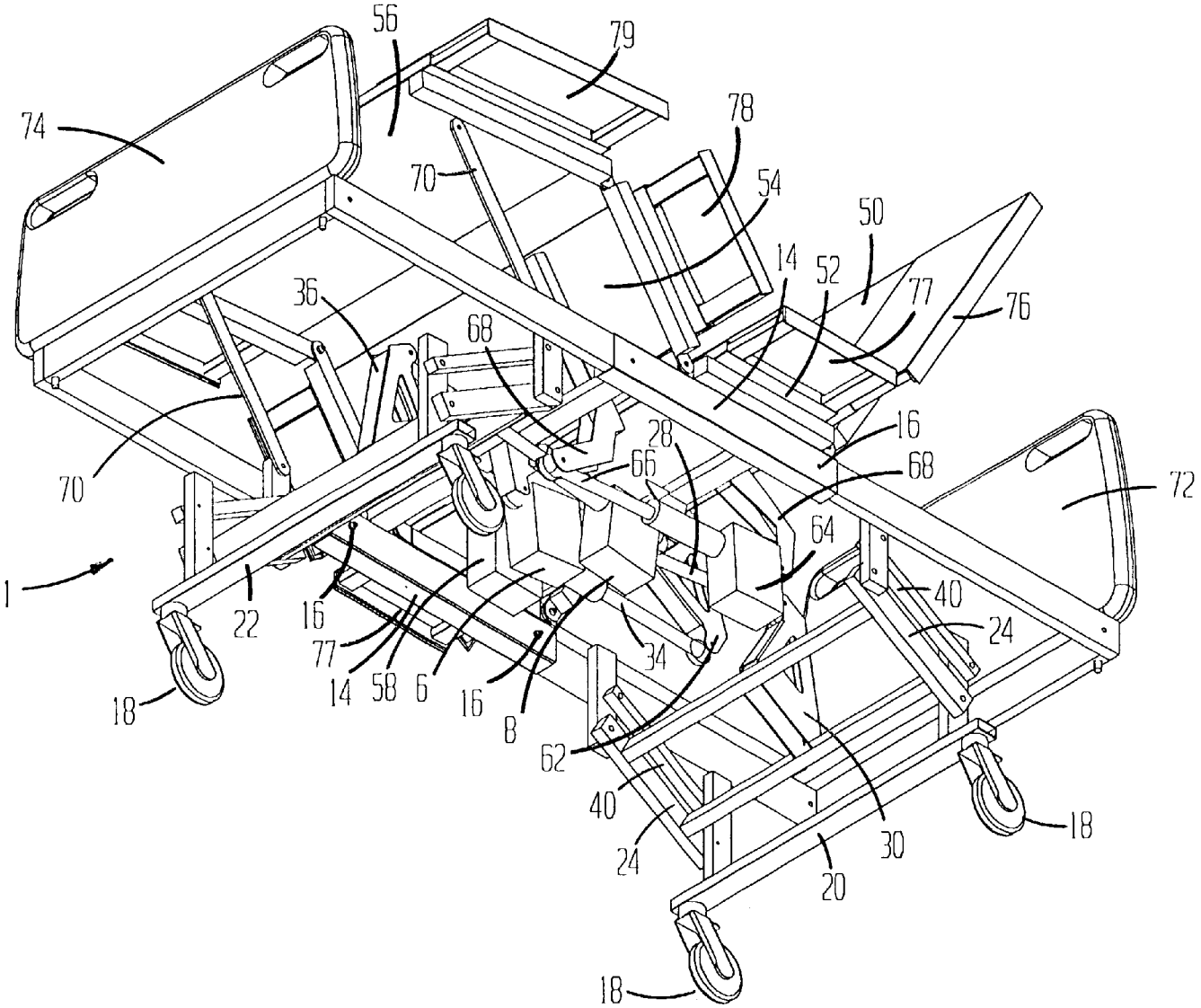
FIGS. 3 and 4 show the bed frame having head, seat, thigh and foot mattress support deck sections attached thereto to vary the contour of a mattress.
Figure 4:
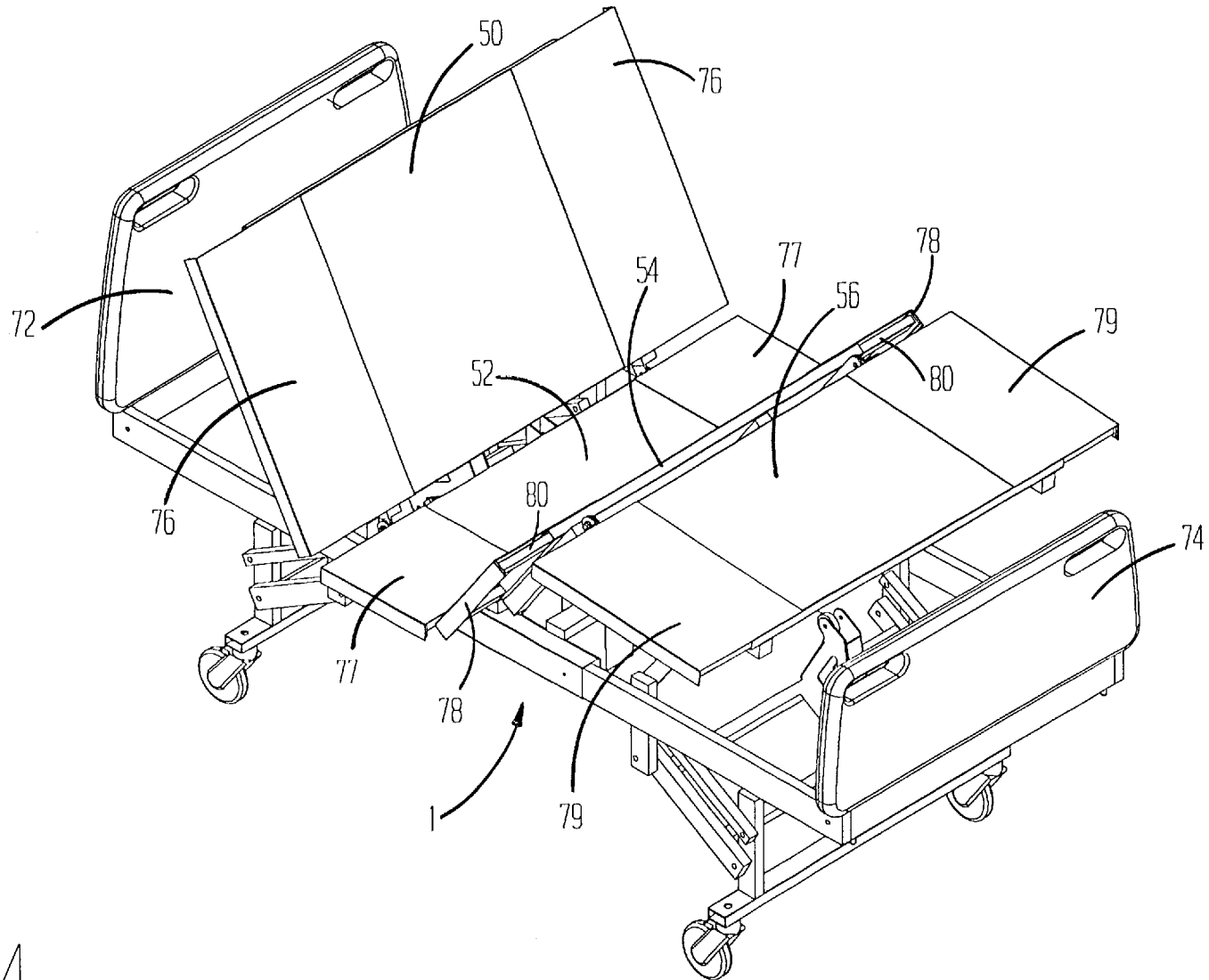

FIGS. 3 and 4 of the drawings show the bed frame 1 of FIGS. 1 and 2 with the attachment of a head mattress support deck section 50, a seat mattress support deck section 52, a thigh mattress support deck section 54, and a foot mattress support deck section 56, whereby the mattress counter may be selectively adjusted. In FIG. 3, the underside of the bed frame 1 is shown so that all four electric motors are visible. One or both of the pair of bed lift motors 6 and 8 of FIGS. 1 and 2 are selectively operated to generate pushing forces to lift one end of the frame 1 or the opposite end of the frame or both ends of the frame. Of course, these same bed lift motors 6 and 8 can generate pulling forces in order to cause the bed frame 1 to move downwardly.

Figure 5:
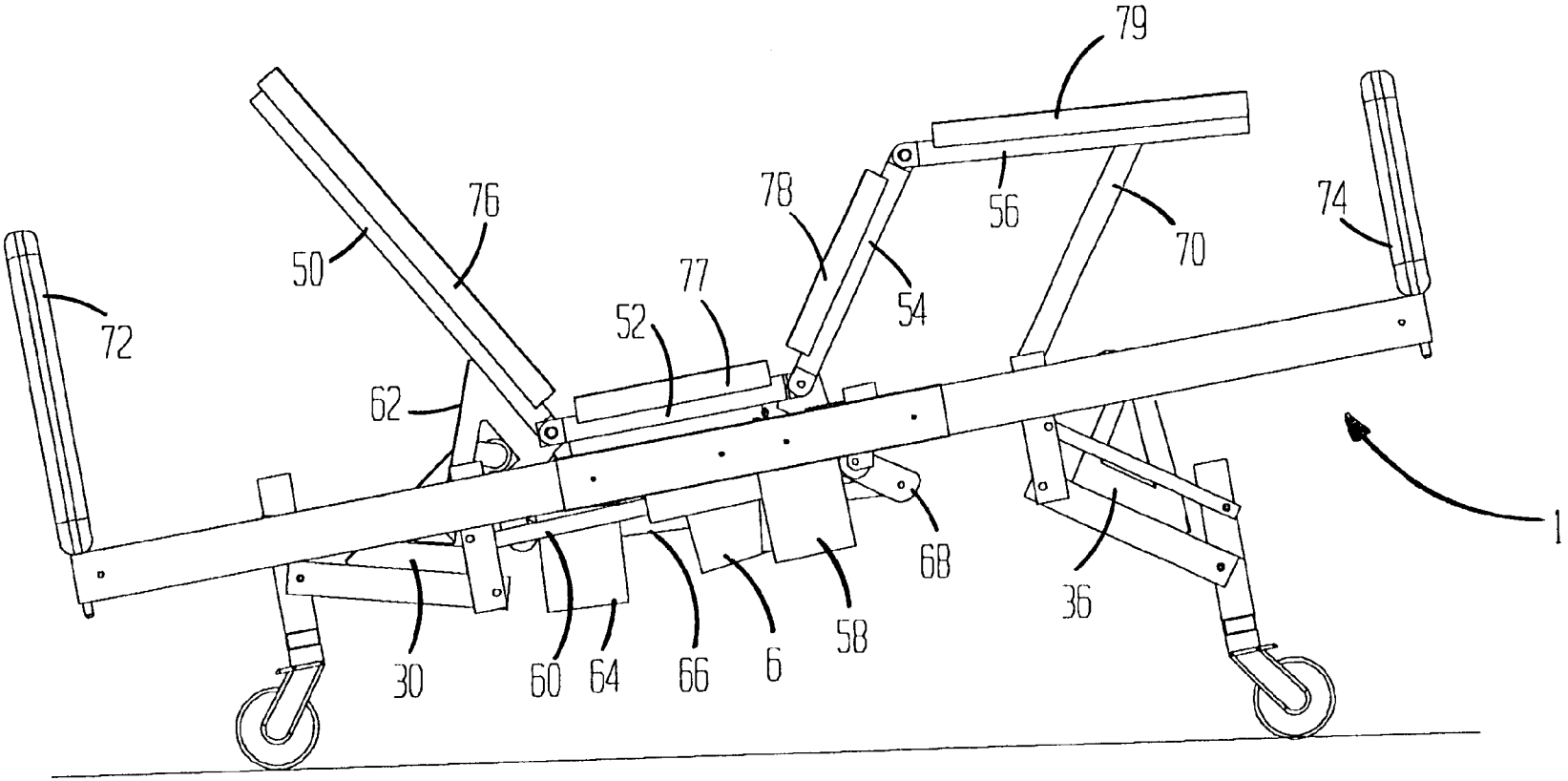
FIG. 5 shows one end of the bed frame elevated by means of a bed lift motor carried by the frame.

Turning to FIG. 5 of the drawings, the bed frame 1 is shown with the foot end lifted by means of selectively operating one of the bed lift motors (e.g. 6). In this case, the frame 1 has a well known Trendelenburg tilt with the foot end raised higher than the head end. In the case where the other bed lift motor 8 is operated, the head end of the frame 1 can be raised higher than the foot end so that the frame will have a reverse Trendelenburg tilt (not shown).

In addition to the pair of bed lift motors 6 and 8, the motor section 11 of bed frame 1 also carries a head mattress support deck section lift motor 58. As is best shown in FIG. 5, lift motor 58 is pivotally coupled by a shaft 60 to a head deck section lift dog 62 to generate a pushing force and thereby cause the head mattress support deck section 50 to rotate upwardly relative to frame 1.

A thigh mattress support deck section lift motor 64 is coupled by a shaft 66 to a thigh deck section lift dog 68 to generate a pushing force and thereby cause the thigh mattress support deck section 54 to rotate upwardly relative to the bed frame 1. It may be appreciated that like the bed lift motors 6 and 8, the head and thigh mattress support deck section lift motors 58 and 64 generate pushing forces via their respective shafts 60 and 66 against the head section lift dog 62 and the thigh section lift dog 68 to cause the head and thigh mattress support deck sections 50 and 54 to be rotated upwardly.

In this regard, the elevation of the bed frame 1 and the rotation of the head and thigh mattress support deck section 50 and 54 in response to pushing forces generated by the lift motors 6, 8, 58 and 64 is an important advantage of the present invention. More particularly, and as opposed to electric motors associated with conventional bed frames which generate pulling forces to lift the frame and its components, it has been found that should any of the aforementioned motors 6, 8, 58 or 64 break, the bed frame 1 and the head and thigh mattress support deck sections 50 and 54 will not drop rapidly in a downward direction against the frame so as to impart an impact force against a patient lying on a mattress. In the event that one of the motors 6, 8 and 58 or 64 should break, the frame 1 as well as the head and thigh mattress support deck sections 50 and 54 will be lowered slowly and gradually in a downward direction so that the patient will not be subjected to shock as might otherwise be encountered in response to a rapid fall.

FIGS. 3 and 5 show a pair of drag links 70 which are pivotally connected between the foot mattress support deck section 56 and the frame 1. The drag links 70 cause the foot mattress support deck section 56 to remain in spaced parallel alignment above the bed frame 1. In addition, the thigh and foot mattress support deck sections 54 and 56 are pivotally connected to one another so that the action of the thigh mattress support deck section lift motor 64 simultaneously controls the lifting and lowering of each of the thigh and foot mattress support deck sections 54 and 56. That is, while the thigh mattress support deck section 54 will rotate upwardly or downwardly relative to the bed frame 1, the foot mattress support deck section 56 will, as previously described, be pulled or pushed along with the deck section 54 to which it is connected.

A stationary seat mattress support deck section 52 is affixed to the frame 1 and does not move with the other mattress support deck sections 50, 54 and 56.

The frame configuration shown in FIGS. 3–5 includes the addition of a headboard 72 and a foot board 74 affixed to the front end frame section 10 and the rear end frame section 11 of bed frame 1.

Figure 6:
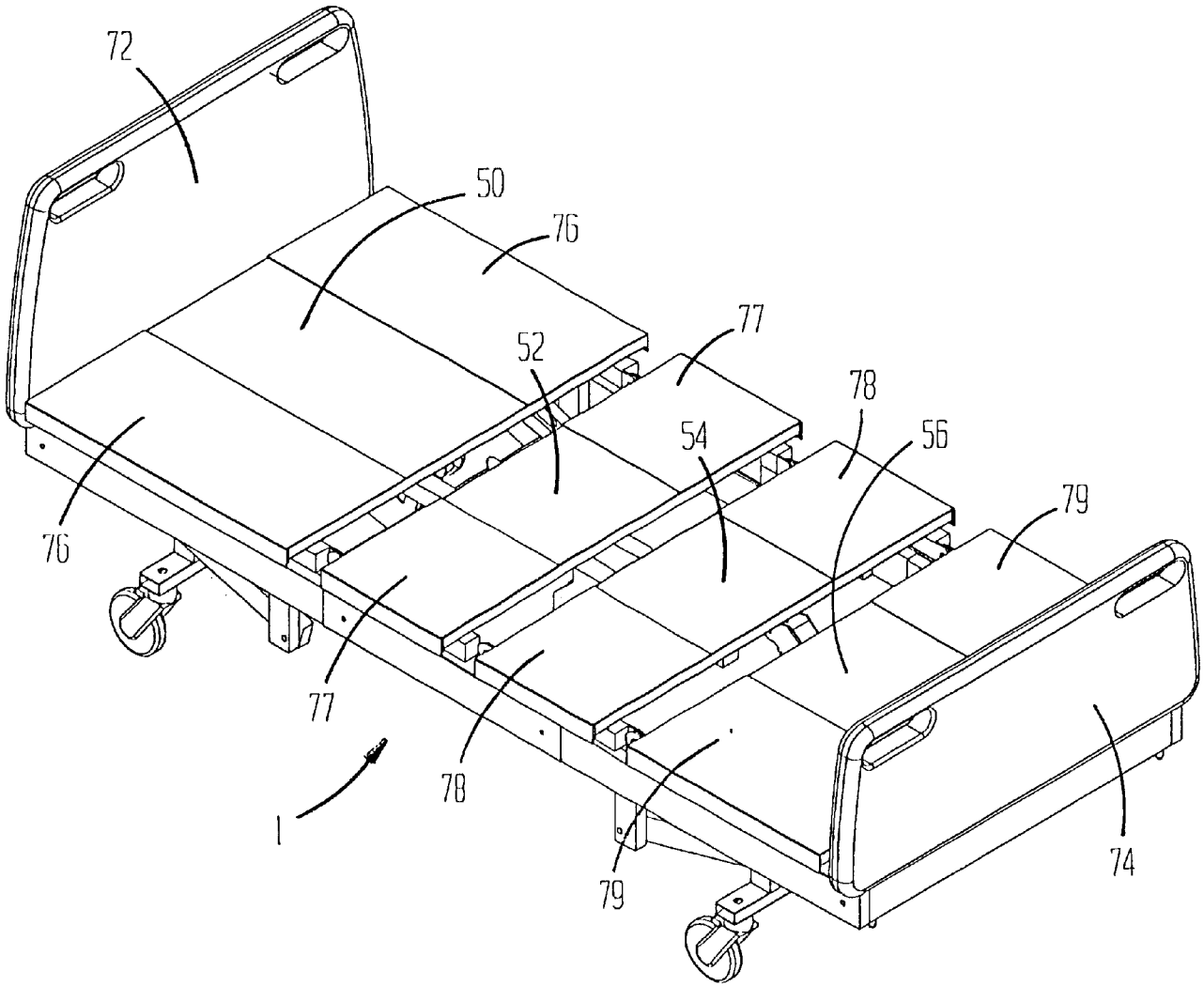
FIG. 6 shows pull out extensions of the head, seat, thigh and foot mattress support deck sections at a retracted position to support a relatively narrow mattress.
Figure 7:
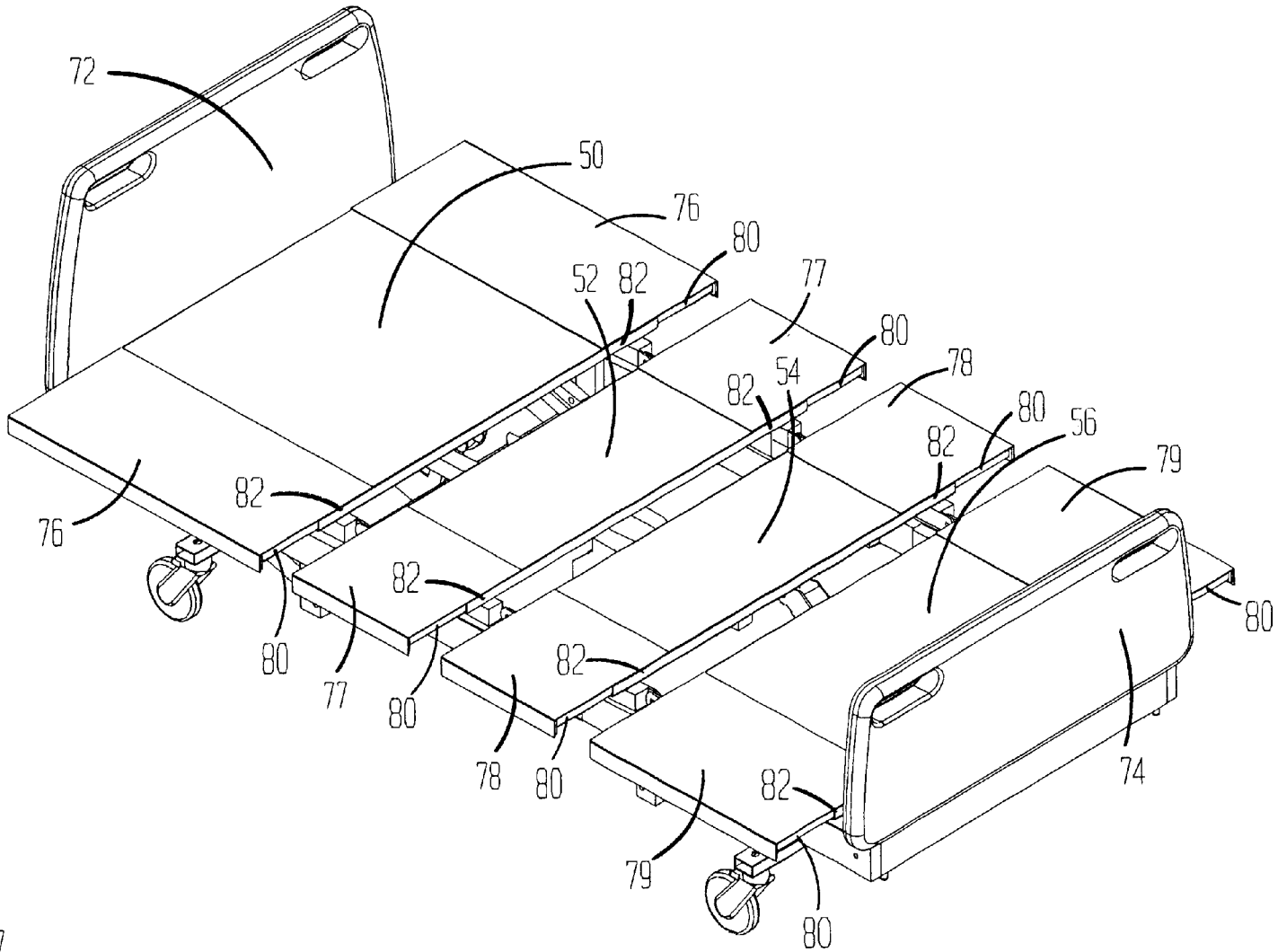
FIG. 7 shows the pull out extensions of FIG. 6 moved to an extended position to support a relatively wide mattress.

FIGS. 6 and 7 of the drawings illustrate another important feature of the present invention. While conventional beds are relatively narrow (i.e. having a maximum width of approximately 36 inches), the present bariatric bed is characterized by a frame 1 which is adapted to expand in width up to 48 inches. The relatively wide bed frame configuration of this invention is particularly useful in supporting those patients who are medically obese. While conventional, relatively narrow bed frames are unable to reliably support the entire body of an obese patient in comfort, the relatively wide bed frame configuration disclosed herein provides adequate support for most obese patients so as to maintain an improved level of comfort.

More particularly, each of the head, seat, thigh and foot mattress support deck sections 50, 52, 54 and 56 of the bed frame 1 has a pair of opposing pull out sections located at opposite sides thereof that are manually and selectively adjusted between the conventional narrow and the improved wide bed frame configurations. FIG. 6 of the drawings shows the bed frame 1 in the relatively narrow width frame configuration so as to be capable of supporting a conventional 36 inch wide mattress. FIG. 7 of the drawings shows the bed frame 1 in the relatively wide bed frame configuration so as to be capable of supporting up to a 48 inch mattress.

As is best shown in FIG. 7, a pair of pull out extensions are slidable outwardly and in opposite directions from the head mattress support deck section 50 from the retracted position of FIG. 6 to an extended position. A pair of pull out extensions 77 are slidable outwardly and in opposite directions from the seat mattress support deck section 52 from the retracted position to the extended position. A pair of pull out extensions 78 are slidable outwardly and in opposite directions from the thigh mattress support deck section 54 and a pair of pull out extensions 79 are slidable outwardly and in opposite directions from the foot mattress support deck section 56.

The slidable movement of the pull out extensions 76–79 between the retracted and extended positions of FIGS. 6 and 7 is accomplished by means of opposing pairs of rails 80 carried along the bottom of each pull out extension. Each pair of rails is adapted to be slidably received within a hollow channel 82 formed along each side of the head, seat, thigh and foot mattress support deck section 50, 52, 54 and 56. As the pull out extensions 76–79 are pulled outwardly from or pushed inwardly towards the respective head, seat, thigh and foot mattress support deck sections 50, 52, 54 and 56, the pairs of rails 80 correspondingly slide outwardly from or inwardly towards the hollow channel 82.

While FIG. 6 illustrates a relatively narrow bed frame configuration with the pull out extensions 76–79 in a retracted position and FIG. 7 illustrates the relatively wide bed frame configuration with the pull out extensions 76–79 in the extended position, it is to be understood that the pullout extensions 76–79 may be moved to any intermediate position between the retracted position of FIG. 6 and the extended position of FIG. 7 so as to accommodate mattresses having different widths.

Figure 8:
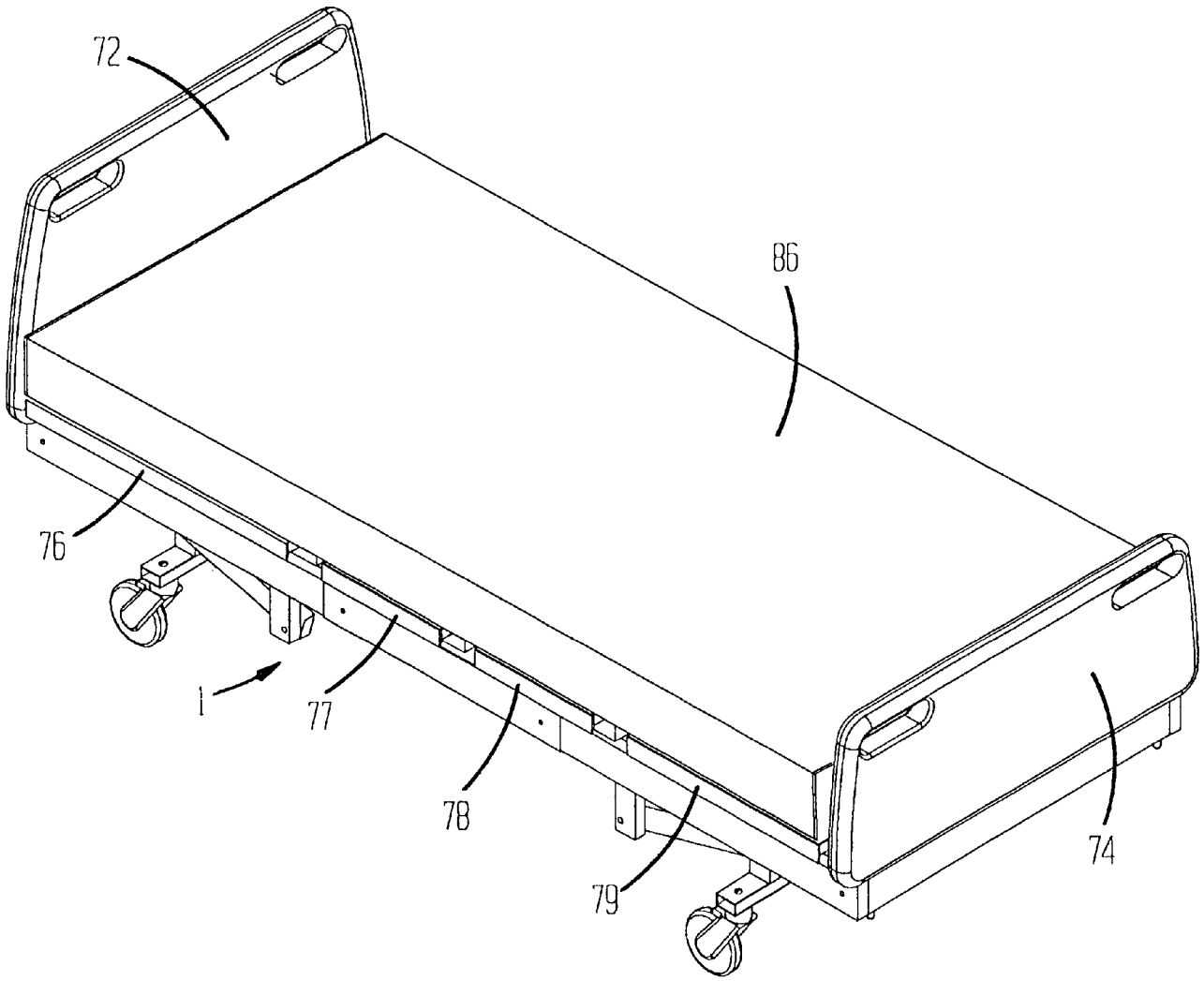
FIG. 8 shows a relatively narrow mattress supported by the mattress support deck sections of FIG. 6 with the pull out extensions thereof at the retracted position.
Figure 9:
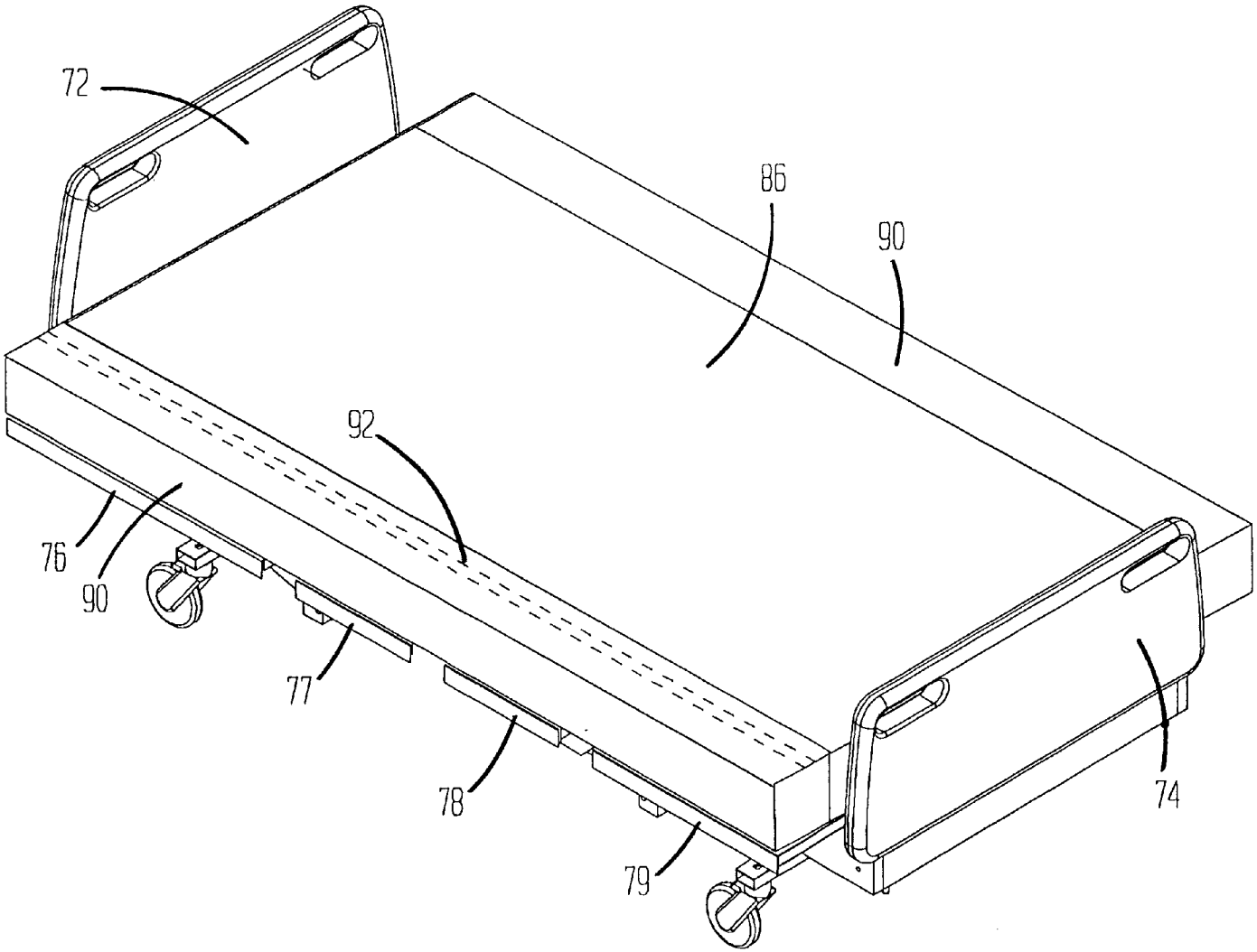
FIG. 9 shows a relatively wide mattress assembly supported by the mattress support deck sections of FIG. 7 with the pull out extensions at the extended position.

FIG. 8 of the drawings shows the bed frame 1 in the relatively narrow configuration of FIG. 6 with the pull out extensions 76–79 of mattress support deck sections 50, 52, 54 and 56 pushed inwardly to the retracted position. In this case, the bed will support a standard 36 inch wide hospital mattress 86.

To provide a suitable mattress to be laid upon the bed frame 1 in the relatively wide configuration of FIG. 7 with the pull out extensions 76–79 moved to the extended position, the standard mattress 86 of FIG. 8 is first laid upon the head, seat, thigh and foot mattress support deck sections 50, 52, 54 and 56. A pair of mattress extensions 90 are then laid alongside the standard mattress 86 so as to be seated upon the pullout extensions 76–79. The mattress extensions 90 may be filled with foam, air or any other suitable soft and resilient material. The mattress extensions 90 are detachably connected to opposite sides of the conventional mattress 86. According to a preferred embodiment of this invention, the mattress extensions 90 are attached to the conventional mattress 86 by means of a zipper assembly 92 which runs longitudinally between the mattress and the extensions.

Because of the relatively soft nature of the mattress extensions 90, a healthcare worker will be able to insert his hand between the mattress 86 and each mattress extension 90 so as to manipulate the zipper assembly 92 in order to either attach or detach the mattress and mattress extensions. However, it is to be understood that other conventional fastening means (e.g. such as that commercially known as Velcro) may also be used to detachably connect the mattress extensions 90 along opposite sides of the conventional mattress 86.

By virtue of the mattress extensions 90, a standard mattress 86 can be used on either of a conventional hospital bed or the bariatric bed of this invention. However, the mattress extensions 90 are easily attached to or separated from the standard mattress 86 so as to facilitate the storage and transport thereof. The mattress extensions 90 may be used whenever the bed frame 1 is required to support an obese patient such that the pullout extensions 76–79 are pulled to the extended position outwardly from their respective head, seat, thigh and foot mattress support deck sections 50, 52, 54 and 56. Thus, it may be appreciated that the bed frame 1 described herein may be used to support both patients of average size and weight or, under special circumstances, patients of large size and weight. However, the bed frame 1 provides the advantage that it may be quickly and easily separated into the modular frame sections 10, 11 and 12 of FIG. 2 to facilitate storage, transport or movement through tight spaces.

I claim:

1. A bed comprising:

a frame having first and opposite ends;

a plurality of deck sections pivotally connected to said frame to support a mattress, said plurality of deck sections including a head mattress support deck section and a thigh mattress support deck section;

a first electric motor carried by said frame to exert a pushing force whereby to cause the first end of said frame to move upwardly relative to a floor surface;

a second electric motor carried by said frame and coupled to said head mattress support deck section to exert a pushing force whereby to cause said head mattress support deck section to rotate upwardly relative to said frame;

a third electric motor carried by said frame and coupled to said thigh mattress support deck section to exert a pushing force whereby to cause said thigh mattress support deck section to rotate upwardly relative to said frame; and a fourth electric motor carried by said frame to exert a pushing force whereby to cause the opposite end of said frame to move upwardly relative to the floor surface and independently of the upward movement of the first end of said frame caused by said first electric motor.

2. The bed recited in claim 1, further comprising a first lift dog connected to the first end of said frame, said first electric motor having a shaft pivotally coupled to said first lift dog such that a pushing force exerted by said first electric motor is transferred to said first lift dog via said shaft whereby to cause the first end of said frame to move upwardly relative to the floor surface.

3. The bed recited in claim 2, further comprising a second lift dog connected to the opposite end of said frame, said fourth electric motor having a shaft pivotally coupled to said second lift dog and exerting a pushing force against said second lift dog via said shaft whereby to cause the opposite end of said frame to move upwardly relative to the floor surface.

4. The bed recited in claim 1, wherein said plurality of deck sections also include a foot mattress support deck section pivotally connected to said thigh mattress support deck section, said third electric motor having a shaft and exerting said pushing force against said thigh mattress support deck section via said shaft whereby to cause said thigh mattress support deck section to rotate upwardly relative to said frame and said foot mattress support deck section to be pulled off said frame by said upwardly rotating thigh mattress support deck section.

5. The bed recited in claim 4, further comprising a drag link pivotally connected between said frame and said foot mattress support deck section, said drag link holding said foot mattress support deck section in spaced, parallel alignment with said frame when said foot mattress support deck section is pulled off said frame by said upwardly rotating thigh mattress support deck section.

6. The bed recited in claim 1, wherein said frame has a front end section, a rear end section, and a middle section, said front end, rear end and middle frame sections being detachably connected to one another.

7. The bed recited in claim 6, wherein said middle frame section includes a pair of hollow frame clamps, said front end and said rear end frame sections being slidably and removably received at respective opposite ends of said pair of hollow frame clamps whereby to connect said front end and said rear end frame sections to said middle frame section.

8. The bed recited in claim 1, wherein each of said plurality of deck sections connected to said frame to support a mattress has at least one pull out extension whereby to increase the size of said deck sections for supporting mattresses having different sizes.

9. The bed recited in claim 8, wherein each of said plurality of deck sections has first and opposite sides and first and opposite pull out extensions slidable outwardly from said first and opposite sides between a retractable position at which said deck sections have a relatively narrow width and an extended position at which said deck sections have a relatively wide width.

10. The bed recited in claim 9, further comprising a mattress to be supported by said plurality of deck sections when said first and opposite pull out extensions are located at said extended position and said deck sections have said relatively wide width, said mattress including a mattress body having first and opposite sides and a pair of mattress extensions releasably connected to respective ones of said first and opposite sides of said mattress body and seated upon said first and opposite pull out extensions.

11. The bed recited in claim 10, further comprising a zipper by which each of said pair of mattress extensions is releasably connected to a respective one of said first and opposite sides of said mattress body.

12. A bed comprising:

a frame;

a plurality of deck sections pivotally connected to said frame to support a mattress, each of said plurality of deck sections having first and opposite sides and first and opposite pull out extensions slidable outwardly from said first and opposite sides between a retracted position at which said plurality of deck sections have a relatively narrow width by which to support a mattress having a correspondingly narrow width and an extended position at which said plurality of deck sections have a relatively wide width by which to support a mattress having a correspondingly wide width; and a plurality of electric motors carried by said frame and coupled to respective ones of said plurality of deck sections for exerting a pushing force on said plurality of deck sections for causing said deck sections to rotate upwardly relative to said frame so as to adjust the contour of the mattress.

13. A bed comprising:

a frame having a front end section, a rear end section and a middle section, each of said front end, rear end and middle sections being removably connected together and detachable from one another to facilitate storage, transport and the relocation of said frame through a narrow entrance;

a plurality of deck sections pivotally connected to one another above said frame to support a mattress, said plurality of deck sections including at least a head mattress support deck section located above the front end section of said frame, a thigh mattress support deck section located above the middle section of said frame, and a foot mattress support deck section located above the rear end section of said frame; and a plurality of electric motors carried by said frame and coupled to certain ones of said plurality of deck sections for exerting a pushing force and thereby causing, said certain deck sections to rotate upwardly relative to said frame so as to adjust the contour of the mattress.

14. The bed recited in claim 13, wherein the middle section of said frame includes hollow opposite ends, the front end and rear end sections of said frame being slidably and removably received within respective ones of said hollow opposite ends, whereby said middle section is detachably connected between the front and rear sections of said frame.

15. The bed recited in claim 13, wherein a first of said plurality of electric motors is coupled to said head mattress support deck section to exert a pushing force and thereby cause said head mattress support deck section to rotate upwardly relative to the front end section of said frame.

16. The bed recited in claim 15, wherein a second of said plurality of electric motors is coupled to said thigh mattress support deck section to exert a pushing force and thereby cause said thigh mattress support deck section to rotate upwardly relative to the middle section of said frame.

17. The bed recited in claim 16, wherein said thigh mattress support and said foot mattress support deck sections are pivotally connected to one another, such that said foot mattress support deck section is pulled away from and rotated upwardly relative to the rear end section of said frame when said thigh mattress support deck section is rotated upwardly relative to the middle section of said frame.

18. The bed recited in claim 16, wherein a third of said plurality of electric motors is connected to the front end section of said frame and a fourth of said plurality of electric motors is connected to the rear end section of said frame, each of said third and fourth electric motors exerting a pushing force whereby to raise the front end and rear end sections of said frame independently of one another.

19. The bed recited in claim 13, wherein said plurality of deck sections also includes a stationary seat mattress support deck section pivotally connected between said head mattress support and said thigh mattress support deck sections and located above the middle section of said frame.

20. The bed recited in claim 13, wherein each of said head mattress support, thigh mattress support and foot mattress support deck section has at least one pull out extension whereby to increase the width of said plurality of deck sections for supporting thereon mattresses of different width.

* * * * *